US007912397B2

(12) United States Patent
Song

(10) Patent No.: US 7,912,397 B2
(45) Date of Patent: Mar. 22, 2011

(54) FUSER, IMAGE FORMING APPARATUS, AND METHOD TO CONTROL THE APPARATUS

(75) Inventor: Hyun Soo Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 443 days.

(21) Appl. No.: 12/023,270

(22) Filed: Jan. 31, 2008

(65) Prior Publication Data

US 2008/0187347 A1 Aug. 7, 2008

(30) Foreign Application Priority Data

Feb. 1, 2007 (KR) ..... 10-2007-0010652
Jan. 16, 2008 (KR) ..... 10-2008-0004919

(51) Int. Cl.
*G03G 15/00* (2006.01)

(52) U.S. Cl. ..... 399/88

(58) Field of Classification Search ..... 399/33, 399/67, 88, 122, 307, 320, 322, 327, 400
See application file for complete search history.

(56) References Cited

U.S. PATENT DOCUMENTS

| | | | | |
|---|---|---|---|---|
| 5,669,038 | A * | 9/1997 | Kishimoto | 399/67 |
| 5,671,462 | A * | 9/1997 | Toyohara et al. | 399/33 |
| 6,034,790 | A * | 3/2000 | Kamei et al. | 358/475 |
| 7,636,527 | B2 * | 12/2009 | Nanba et al. | 399/69 |
| 2003/0072581 | A1 * | 4/2003 | Nishida | 399/67 |
| 2003/0103778 | A1 | 6/2003 | Meads et al. | |
| 2005/0141913 | A1 * | 6/2005 | Song et al. | 399/69 |

* cited by examiner

*Primary Examiner* — David P Porta
*Assistant Examiner* — Kiho Kim
(74) *Attorney, Agent, or Firm* — Stanzione & Kim LLP

(57) ABSTRACT

A fuser, an image forming apparatus, and a method to control the apparatus includes a power supply unit to supply power to a plurality of heat sources provided in the fuser, and is controlled to gradually increase and change in a stepwise manner an amount of current supplied alternately to the plurality of heat sources, thereby preventing an inrush current and uneven fusing of images.

19 Claims, 13 Drawing Sheets

FIG. 1
(CONVENTIONAL)
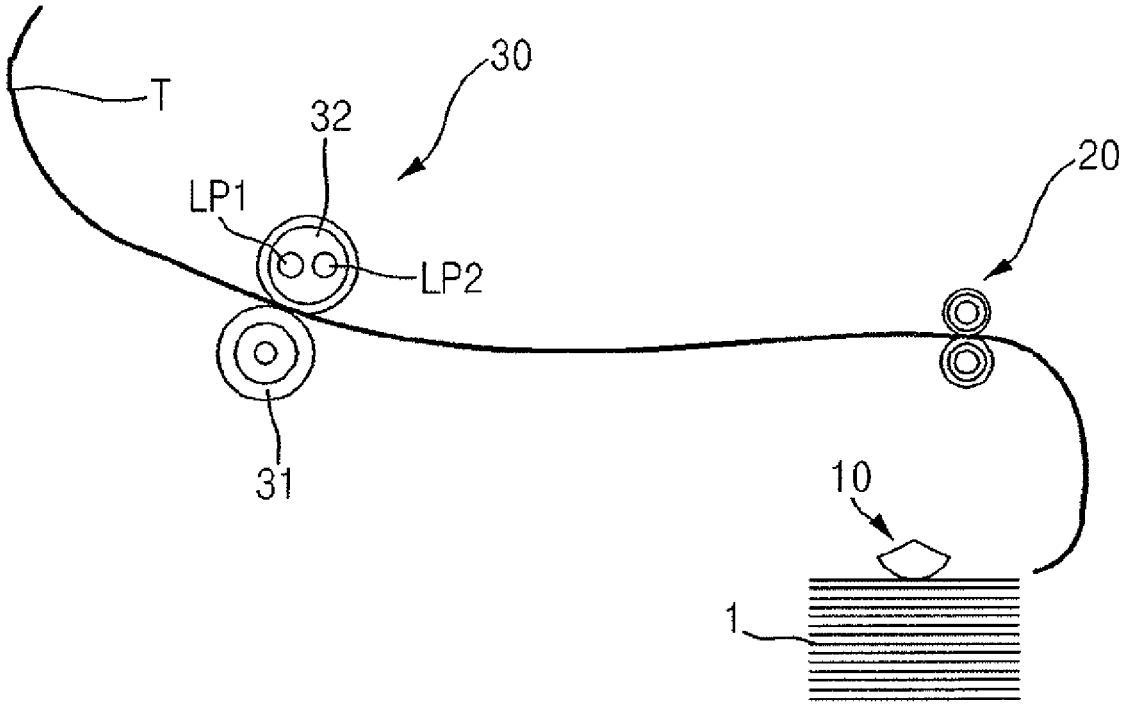

FIG. 2
(CONVENTIONAL)
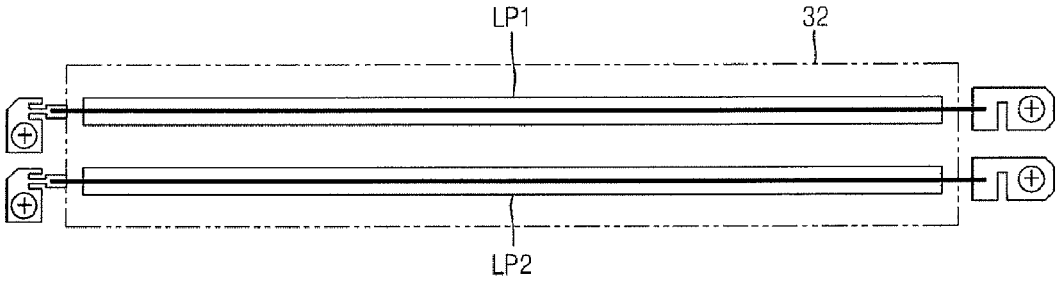

FIG. 3
(CONVENTIONAL)
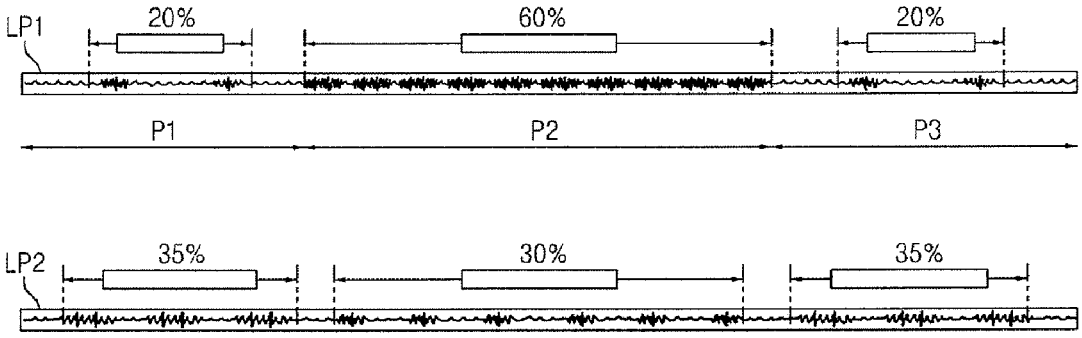

FIG. 4
(CONVENTIONAL)
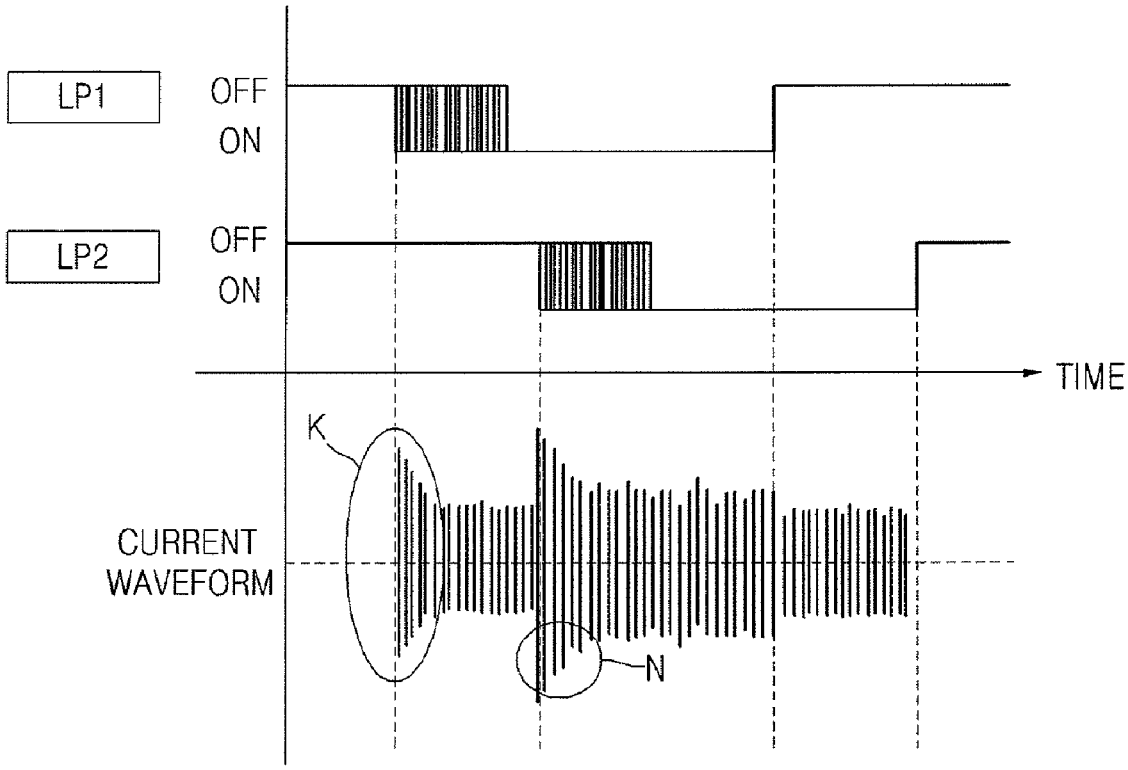

FIG. 5
(CONVENTIONAL)
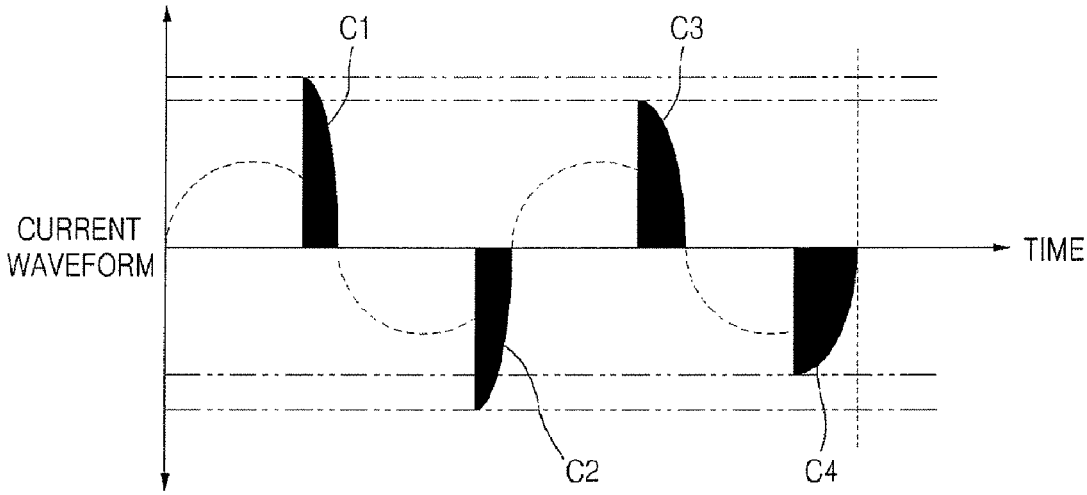

FUSER, IMAGE FORMING APPARATUS, AND METHOD TO CONTROL THE APPARATUS

CROSS-REFERENCE TO RELATED APPLICATIONS

This application claims priority under 35 U.S.C. §119(a) from Korean Patent Application No. 2007-0010652, filed on Feb. 1, 2007 and No. 2008-4919, filed on Jan. 16, 2008 in the Korean Intellectual Property Office, the disclosures of which are incorporated herein in their entirety by reference.

BACKGROUND OF THE INVENTION

1. Field of the Invention

The present general inventive concept relates to a fuser, an image forming apparatus, and a method to control the apparatus, and more particularly, to a fuser, an image forming apparatus, and a method by controlling the apparatus to control currents supplied to a plurality of heat sources.

2. Description of the Related Art

Image forming apparatuses such as general printers and all-in-one printers generally include a fuser to fuse a transferred image onto a print sheet.

As illustrated in FIG. 1, a feed roller 10 provided at an upstream portion of a paper conveyance path T feeds print sheets 1 one by one to be conveyed to a registration roller 20. When the registration roller 20 transfers the print sheet 1 to a fuser 30 provided at a downstream portion of the paper conveyance path T, the fuser 30 fixes an image transferred onto the print sheet 1.

The fuser 30 includes a pressure roller 31 and a heating roller 32 that are provided opposite each other to apply pressure and heat to the print sheet 1 to fuse an image to the print sheet 1. As illustrated in FIG. 2, the heating roller 32 includes a plurality of heat sources such as heat lamps LP1 and LP2 that are provided in parallel in a longitudinal direction in the heating roller 32. A halogen lamp can be used as each of the heat sources LP1 and LP2.

The image forming apparatus may use sheets of various sizes. The print sheet 1 passes through a gap between the pressure roller 31 and the heating roller 32. There is a need to control a fusing temperature based on a heated position of the respective sheet according to a size of the sheet.

As illustrated in FIG. 3, different illumination rates are set for longitudinal portions of the first and second lamps LP1 and LP2. For example when using first and second lamps LP1 and LP2 with a highest output power of 700 W, the image forming apparatus distributes 60% of the highest output power to a center portion P2 of the first lamp LP1, with which various types of sheets with different sizes are brought into contact, and distributes 20% to each of two outer portions thereof P1 and P3 with which no narrow sheets are brought into contact. Alternatively, the image forming apparatus distributes 30% of the highest output power to a center portion P2 of the second lamp LP2 and distributes 35% to each of the two outer portions thereof P1 and P3.

When the lamp is turned on, a large amount of current instantly flows to cause an instant decrease in AC input voltage. This has a negative effect on voltage supply to other electric devices that share an outlet with the image forming apparatus. For example, the instant voltage decrease causes flickering of light emitting devices such as incandescent lamps.

In one method illustrated in FIG. 4, when there is a need to use a plurality of lamps LP1 and LP2, the first lamp LP1 is first turned on and the second lamp LP2 is then turned on when a predetermined time has elapsed so that the first lamp LP1 becomes stable.

Another method is to gradually change a level and volume of current supplied to a lamp at an initial activation time of the lamp. As illustrated in FIG. 5, current waveforms C1 and C2 at a small level and with a small volume are first supplied to the lamp and current waveforms C3 and C4 at a small level and with a large volume are then supplied to the lamp.

However, the conventional image forming apparatus has the following problems. When there is a need to fuse an image using a plurality of heat sources, a long time is required for the apparatus to drive all the heat sources since the apparatus drives one of the heat sources after waiting until an other heat source becomes stable. Thus, the apparatus requires a long waiting time until a heating temperature reaches a fusing temperature to fuse an image to paper. If printing is performed on a print paper before the heating temperature reaches the fusing temperature, differences in temperatures of positions of the print paper heated by the heating roller cause uneven fusing of images throughout the print paper.

An inrush current may also occur at an initial activation time of each of the plurality of heat sources. For example, as illustrated in FIG. 4, an inrush current may occur at the time K when the first lamp is turned on and at the time N when the second lamp is turned on. The inrush current may cause flickering.

SUMMARY OF THE INVENTION

The present general inventive concept provides a fuser, an image forming apparatus, and a method to control the apparatus by controlling currents supplied to a plurality of heat sources provided in the fuser, thereby preventing fusing failure.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a fuser including a heating member having a plurality of heat sources, and a controller to control power supplied to each of the plurality of heat sources such that an amount of a current supplied to each of the plurality of heat sources is increased gradually and is changed in a stepwise manner.

The controller may change a chopping rate of power to change the amount of the current.

The chopping rate may include a plurality of chopping rates and the controller may use the plurality of chopping rates when changing the amount of the current alternately supplied to the plurality of heat sources in the stepwise manner.

The foregoing and/or other aspects and utilities of the present general inventive concept may also be achieved by providing an image forming apparatus including a fuser including a plurality of heat sources, a power supply unit to supply power to the plurality of heat sources, and a controller to control the power supply unit such that an amount of a current supplied to each of the plurality of heat sources is increased gradually and is changed in a stepwise manner from a change start time to a change end time.

The controller may change a chopping rate of the power to change the amount of the current.

The controller may alternately increase the chopping rate for the plurality of heat sources.

The apparatus may further include a storage unit to store a plurality of chopping rates for each of the plurality of heat sources, wherein the controller changes the chopping rate of the power to a desired one of the plurality of chopping rates.

The power supply unit may include a switch connected to a power source to supply the power, wherein the controller controls the switch according to the chopping rate on a basis of a half cycle of the power.

The power supply unit may include a zero crossing detector to detect zero crossing of the power.

The foregoing and/or other aspects and utilities of the present general inventive concept may also be achieved by providing a method to control an image forming apparatus, the method including determining whether there is a need to change an amount of a current supplied to each of a plurality of heat sources provided in a fuser, and gradually increasing and changing, in a stepwise manner, the amount of the current supplied to each of the plurality of heat sources if there is a need to change the amount of the current.

Changing the amount of the current may include changing a chopping rate of power.

Changing the amount of the current may further include detecting zero crossing of the power, and changing the chopping rate on a basis of a half cycle of the power according to the detected zero crossing.

Changing the amount of the current may further include alternately increasing the chopping rate for the plurality of heat sources.

The foregoing and/or other aspects and utilities of the general inventive concept may also be achieved by providing a fuser unit usable with an image forming apparatus, the fuser unit including a first and second heating source to fuse an image on a printing medium, and a controlling unit to apply current to the first heat source to reach a first predetermined level, and to apply current to the second heat source to reach a second predetermined level prior to the first heat source reaching the first predetermined level.

An amount of the current applied to the first and second heat sources, respectively, may be based on predetermined chopping rates, a number of heating sources to be activated, and a size of the printing medium.

The foregoing and/or other aspects and utilities of the general inventive concept may also be achieved by providing a fuser unit usable with an image forming apparatus, the fuser unit including a first and second heating source to fuse an image on a printing medium, and a controlling unit to increase predetermined chopping rates of a first and second heat source at substantially different times during a same interval.

The fuser unit may further include a power unit to receive AC power and to supply power to the first and second heating sources.

The same interval may correspond to one half cycle of the AC power.

The foregoing and/or other aspects and utilities of the general inventive concept may also be achieved by providing a fusing method of a fusing unit, the method including fusing an image on a printing medium by a first and second heating source, applying current to the first heat source to reach a first predetermined level, and applying current to the second heat source to reach a second predetermined level prior to the first heat source reaching the first predetermined level.

The foregoing and/or other aspects and utilities of the general inventive concept may also be achieved by providing a computer-readable recording medium having embodied thereon a computer program to execute a method, wherein the method includes fusing an image on a printing medium by a first and second heating source, applying current to the first heat source to reach a first predetermined level, and applying current to the second heat source to reach a second predetermined level prior to the first heat source reaching the first predetermined level.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 illustrates a fuser provided on a conveyance path of a print sheet in a conventional image forming apparatus;

FIG. 2 illustrates a configuration of a plurality of lamps provided in a heating roller in the conventional image forming apparatus;

FIG. 3 illustrates luminance distribution of the plurality of lamps in the conventional image forming apparatus;

FIG. 4 illustrates activation times and current waveforms of the plurality of lamps in the conventional image forming apparatus;

FIG. 5 illustrates current waveforms at an initial lamp activation time in FIG. 4;

DETAILED DESCRIPTION OF THE PREFERRED EMBODIMENTS

Figure 6:
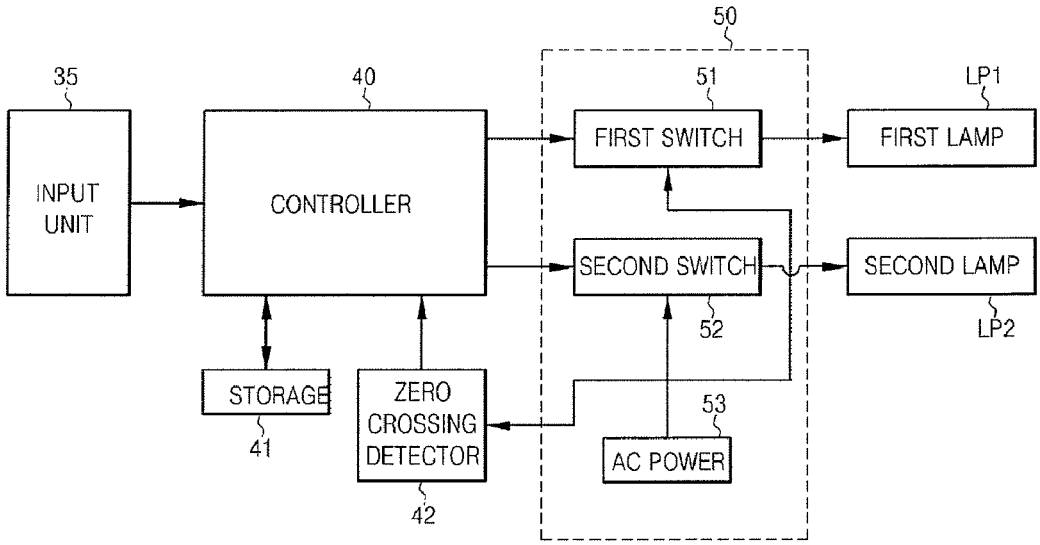
FIG. 6 is a block diagram illustrating an image forming apparatus according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 6 is a block diagram illustrating an image forming apparatus according to an embodiment of the present general inventive concept.

Referring to FIG. 6, the image forming apparatus according to the present embodiment includes a plurality of lamps LP1 and LP2, a controller 40, and a power supply unit 50. The controller 40 outputs control signals to control the plurality of lamps LP1 and LP2. The power supply unit 50 supplies drive power to the lamps LP1 and LP2 according to the control signals from the controller 40.

The power supply unit 50 includes a plurality of switches 51 and 52 to individually supply AC power 53 to the lamps LP1 and LP2.

The image forming apparatus also includes an input unit 35 to allow a user to input overall user commands for print jobs including a command to select a size of paper.

The controller 40 is connected to a storage unit 41 and a zero crossing detector 42.

The storage unit 41 stores information of chopping rates associated with amounts of current supplied to drive the plurality of lamps and also stores information required to perform print jobs.

The zero crossing detector 42 detects zero crossing of the AC power 53 and provides the detected signal to the controller 40.

The controller 40 performs initialization when receiving a print command through the input unit 35. The initialization includes a series of print processes such as paper feeding, development, transfer, and fusing.

The controller 40 receives, from the storage unit 41, information regarding respective chopping rates of lamps and a number of lamps to be driven taking into consideration a size of print paper.

The first switch 51 switches the AC power 53 applied to the first lamp LP1 according to a control signal from the controller 40 and the second switch 52 also switches the AC power 53 applied to the second lamp LP2 according to a control signal from the controller 40. The first and second switches 51 and 52 may be implemented using a triode for alternating current (TRIAC).

Figure 7:
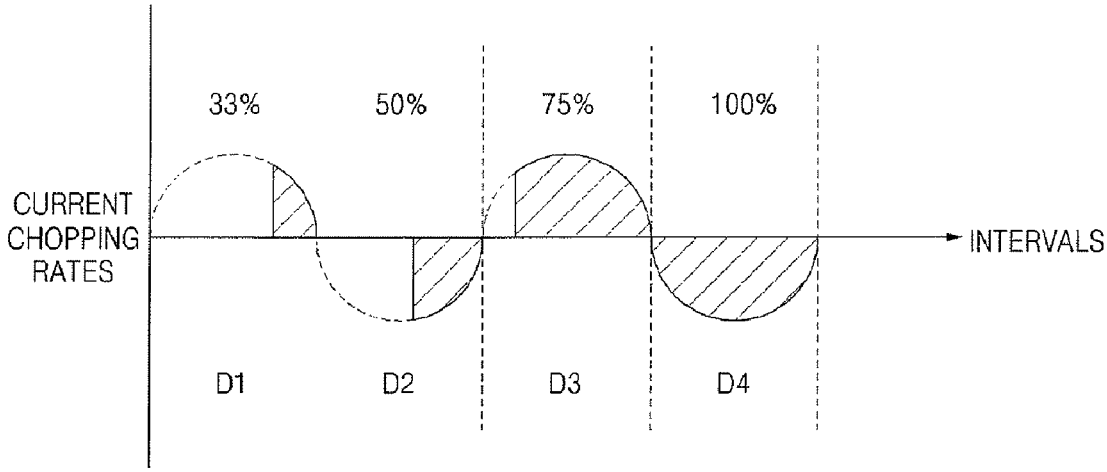
FIG. 7 illustrates current chopping rates applied to the image forming apparatus of FIG. 6.

The controller 40 controls the first and second switches 51 and 52 using preset current chopping rates to control the amounts of currents applied to the first and second lamps LP1 and LP2. As illustrated in FIG. 7, each current chopping rate is determined according to the amount of current supplied in each half cycle of the AC power 53. Each of a plurality of intervals D1, D2, D3, and D4 illustrated in FIG. 7 corresponds to a half cycle of the AC power.

As illustrated in FIG. 7, current chopping rates of 0%, 33%, 50%, 75%, and 100% are used in the present embodiment. However, the present general inventive concept is not limited to such rates and other current chopping rates and other number of current chopping rates may be set appropriately as needed.

In the following embodiments of the present general inventive concept, a large amount of current is not instantly supplied to a plurality of lamps. In addition, after one of the lamps is activated, the other lamp is activated even before the previously activated lamp becomes stable, thereby preventing uneven fusing of images due to different activation times of the lamps.

Figure 8:
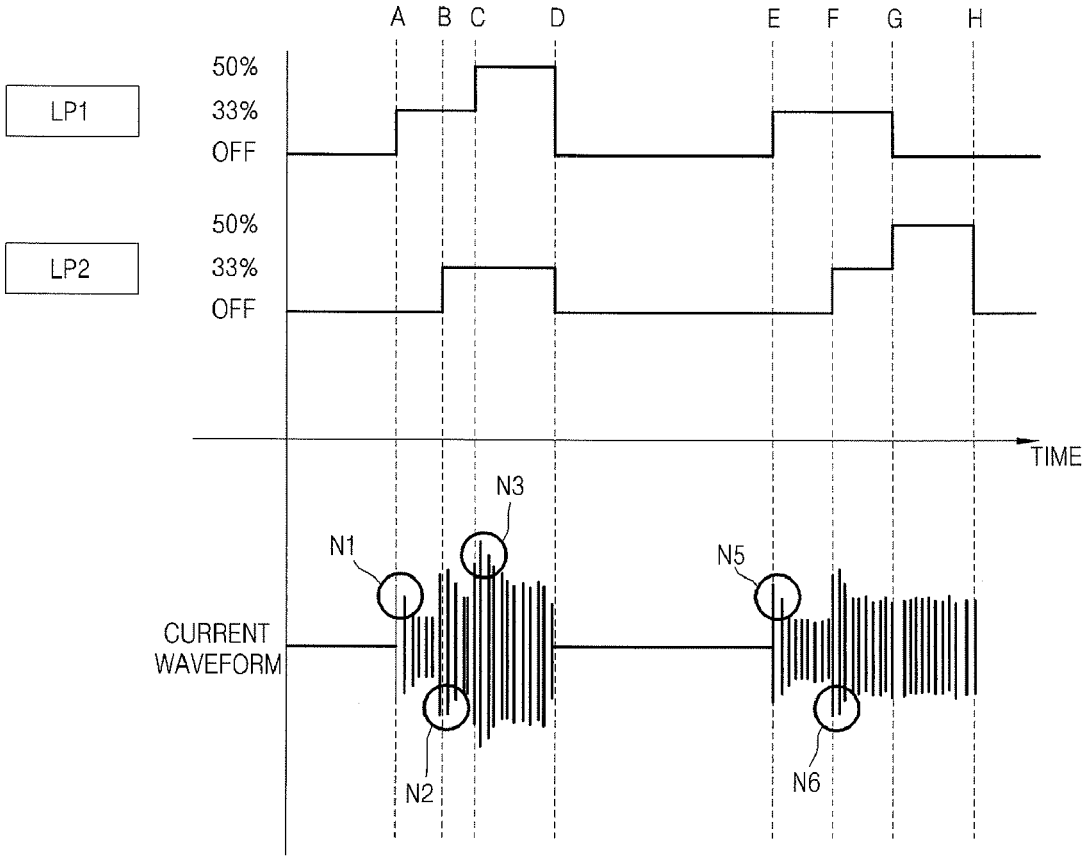
FIG. 8 illustrates activation times and current waveforms of a plurality of lamps according to an embodiment of the present general inventive concept.

FIG. 8 illustrates activation times and current waveforms of a plurality of lamps according to an embodiment of the present general inventive concept.

The controller 40 operates the first and second lamps LP1 and LP2 according to preset current chopping rates. When the controller 40 needs to increase the amount of current applied to one of the first or second lamps LP1 and LP2, the controller 40 increases the current chopping rate of the lamp in a stepwise manner until the amount of current applied to the lamp reaches a desired level. Even while the current chopping rate of one of the lamps is increased, i.e., even when the amount of current applied to the lamp has not reached a desired level, the controller 40 increases the current chopping rate of the other lamp.

As illustrated in FIG. 8, first, at time A, the controller 40 sets the current chopping rate of the first lamp LP1 to 33%. Then, at time B, the controller 40 sets the current chopping rate of the second lamp LP2 to 33% while maintaining the current chopping rate of the first lamp LP1 at 33%.

At time C, the controller 40 changes the current chopping rate of the first lamp LP1 to 50% while maintaining the current chopping rate of the second lamp LP2 at 33%. Then, at time D, the controller 40 turns off both the first and second lamps LP1 and LP2.

Then, at time E when a predetermined time has elapsed after the time D, the controller 40 sets the current chopping rate of the first lamp LP1 to 33%. Then, at time F, the controller 40 sets the current chopping rate of the second lamp LP2 to 33% while maintaining the current chopping rate of the first lamp LP1 at 33%. At time G, the controller 40 turns off the first lamp LP1 and changes the current chopping rate of the second lamp LP2 to 50%. Then, at time H, the controller 40 turns off the second lamp LP2.

Here, the current chopping rates of the plurality of lamps may be reduced or turned off at any other times.

However, inrush currents, though small, may occur at times N1, N2, N3, N5, and N6 when increasing the current chopping rates of the first and second lamps LP1 and LP2.

To cope with an occurrence of small inrush currents, intervals, at which the current chopping rates of currents supplied to the plurality of lamps are increased, are set to be small, which will now be described with reference to FIG. 9.

Figure 9:
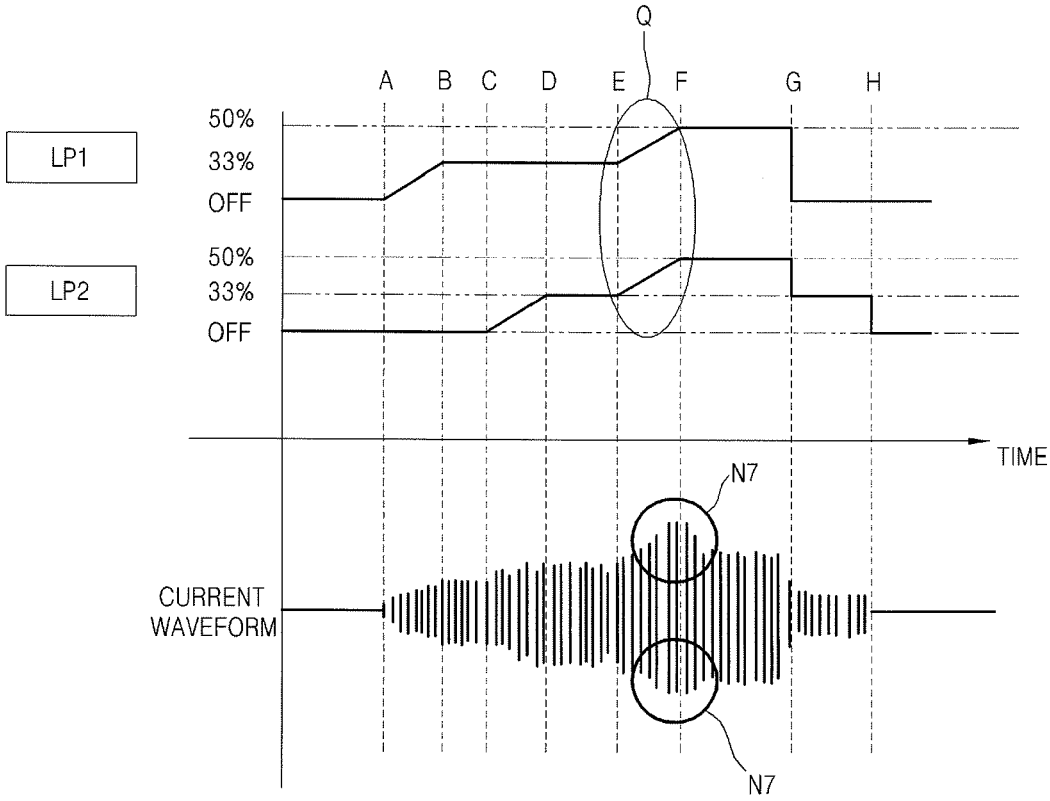
FIG. 9 illustrates activation times and current waveforms of the plurality of lamps according to an other embodiment of the present general inventive concept.

FIG. 9 illustrates activation times and current waveforms of the plurality of lamps according to an other embodiment of the present general inventive concept.

At time A, the controller 40 increases the current chopping rate of the first lamp LP1 as illustrated in FIG. 9. Here, the controller 40 increases the current chopping rate applied to the first lamp LP1 at intervals of several percent until the current chopping rate of the first lamp LP1 reaches 33%. When the current chopping rate of the first lamp LP1 reaches 33% at time B, the controller 40 maintains the current chopping rate at 33%. Thereafter, at time C, the controller 40 increases the current chopping rate applied to the second lamp LP2 at intervals of several percent until the current chopping rate of the second lamp LP2 reaches 33%.

Then, from time E to time F, the controller 40 increases both the current chopping rates applied to the first and second lamps LP1 and LP2 at intervals of several percent so that the current chopping rates of the first and second lamps LP1 and LP2 reach 50%. Even though both the current chopping rates applied to the first and second lamps LP1 and LP2 are increased at intervals of several percent in this manner, an inrush current may occur at time N7 when a large amount of current is supplied.

Figure 10:
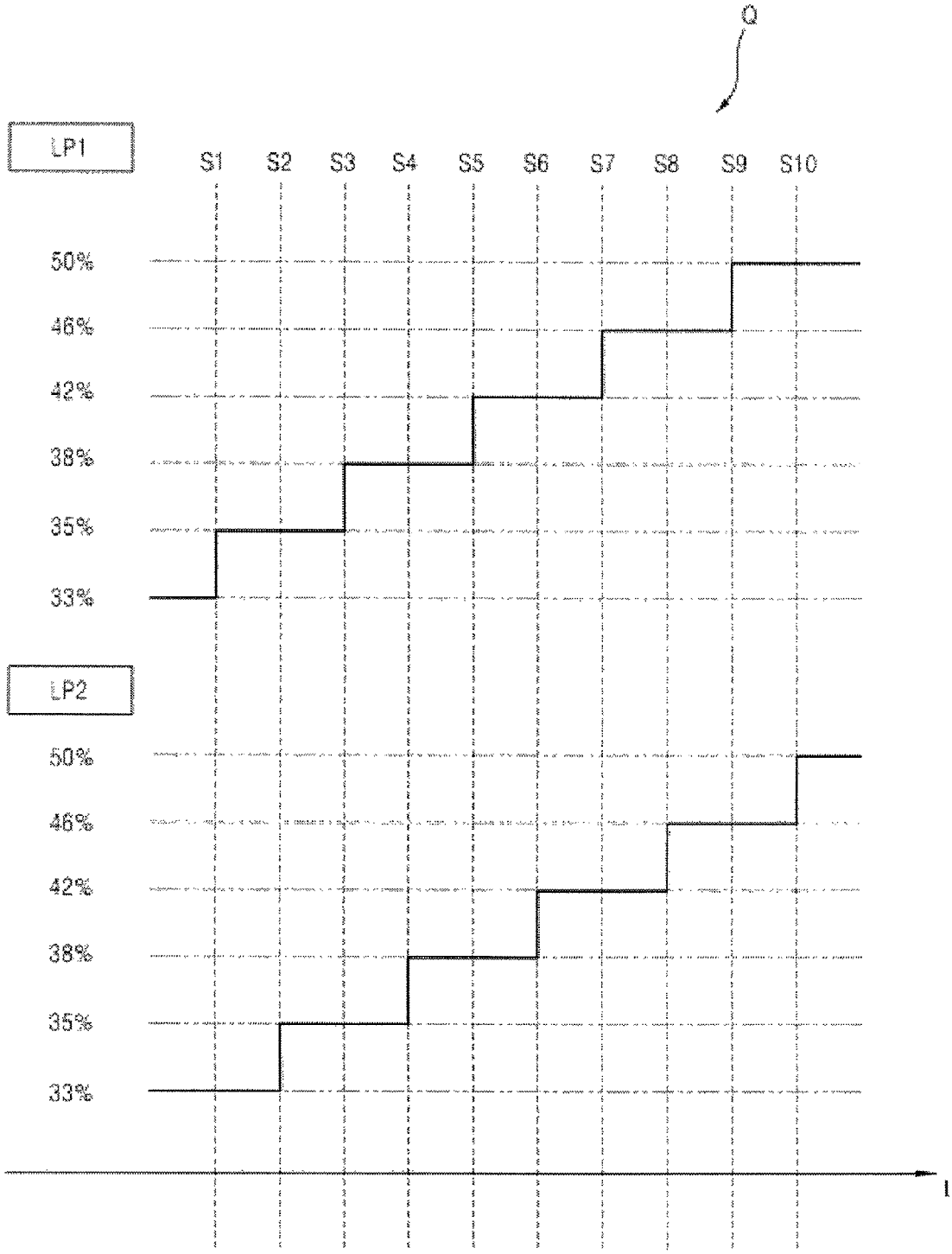
FIG. 10 illustrates activation times of the plurality of lamps in an interval during which current chopping rates of the lamps are all increased according to the other embodiment of the present general inventive concept.

Therefore, the controller 40 increases the current chopping rates of the first and second lamps LP1 and LP2 at different times in the time interval of E to F in which an inrush current may occur (Q). As illustrated in FIG. 10, the controller 40 increases the current chopping rates of the first and second lamps LP1 and LP2 at intervals of 2% alternately rather than simultaneously. Specifically, the current chopping rate of the first lamp LP1 is increased at times S1, S3, S5, S7, and S9 whereas the current chopping rate of the second lamp LP2 is increased at times S2, S4, S6, S8, and S10.

Figure 11:
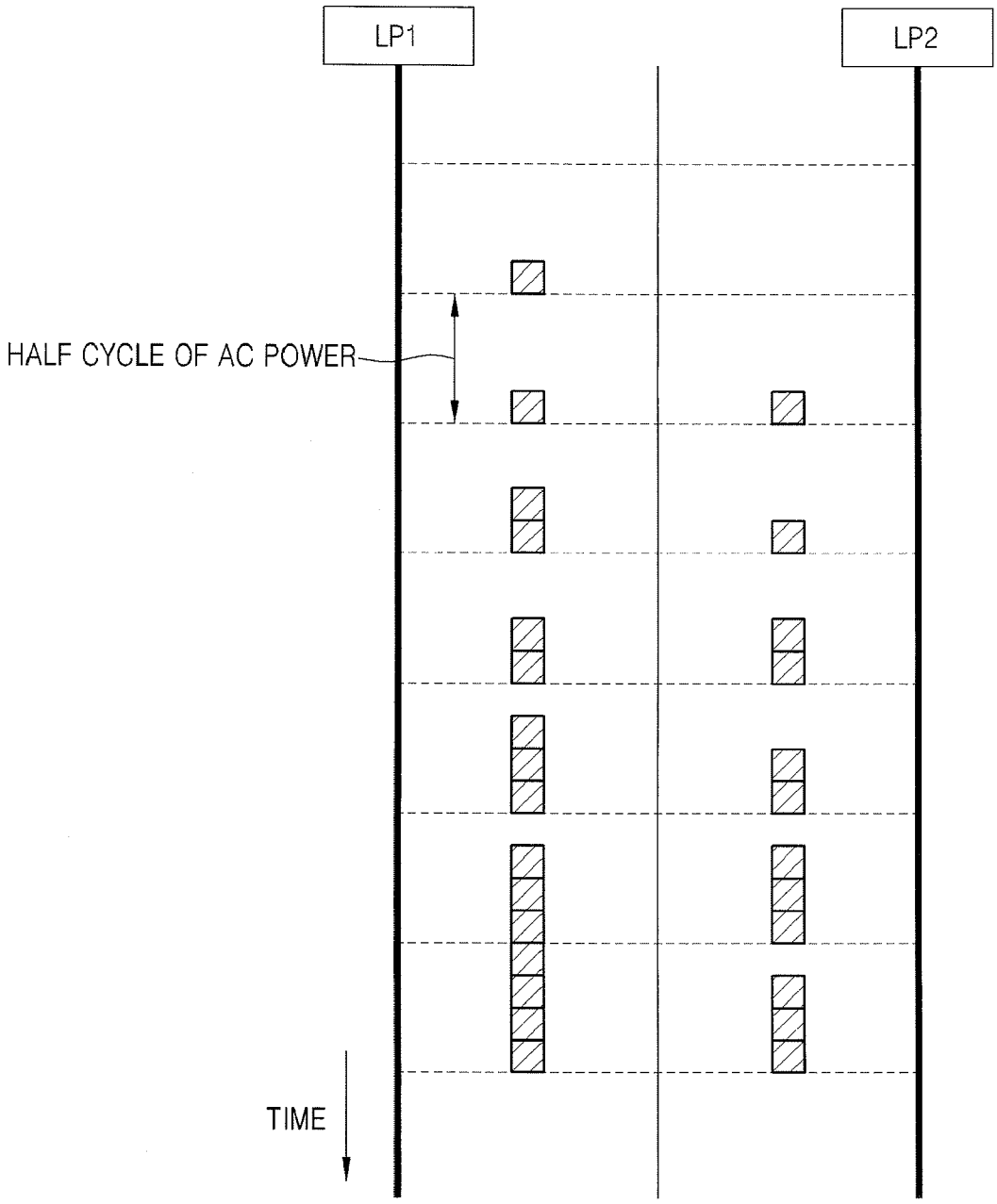
FIG. 11 illustrates the chopping rates of currents applied to the plurality of lamps according to the method of FIG. 10.

According to the other embodiment described above, the current chopping rates of the plurality of lamps are increased at substantially different times although the current chopping rates are all increased during a specific interval. Here, the current chopping rate of each of the plurality of lamps is increased at intervals of one half cycle of the AC power as illustrated in FIG. 11.

Reference will now be made to a method to control the image forming apparatus according to the present general inventive concept constructed as described above.

Figure 12:
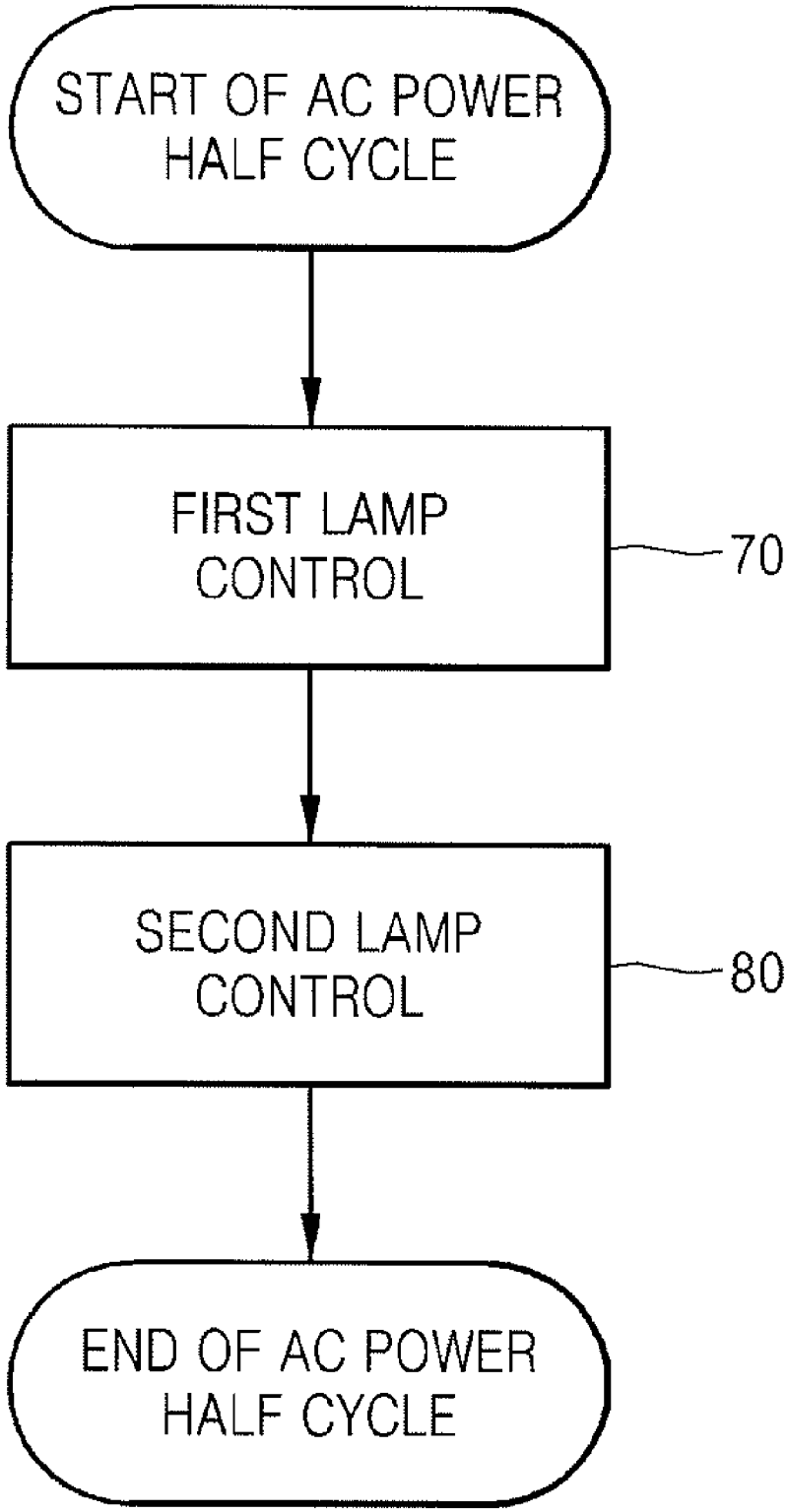
FIG. 12 is an overall flow chart illustrating a method to control an image forming apparatus according to an embodiment of the present general inventive concept.

Referring to FIGS. 6 and 12, the current chopping rates of the plurality of lamps are set on an AC power half-cycle basis. From the start time to the end time of a half cycle of AC power, the controller 40 performs a first lamp control operation to change an amount of current supplied to the first lamp LP1 in a stepwise manner (operation 70) and then performs a second lamp control operation to change the amount of current supplied to the second lamp LP2 in a stepwise manner (operation 80).

Figure 13:
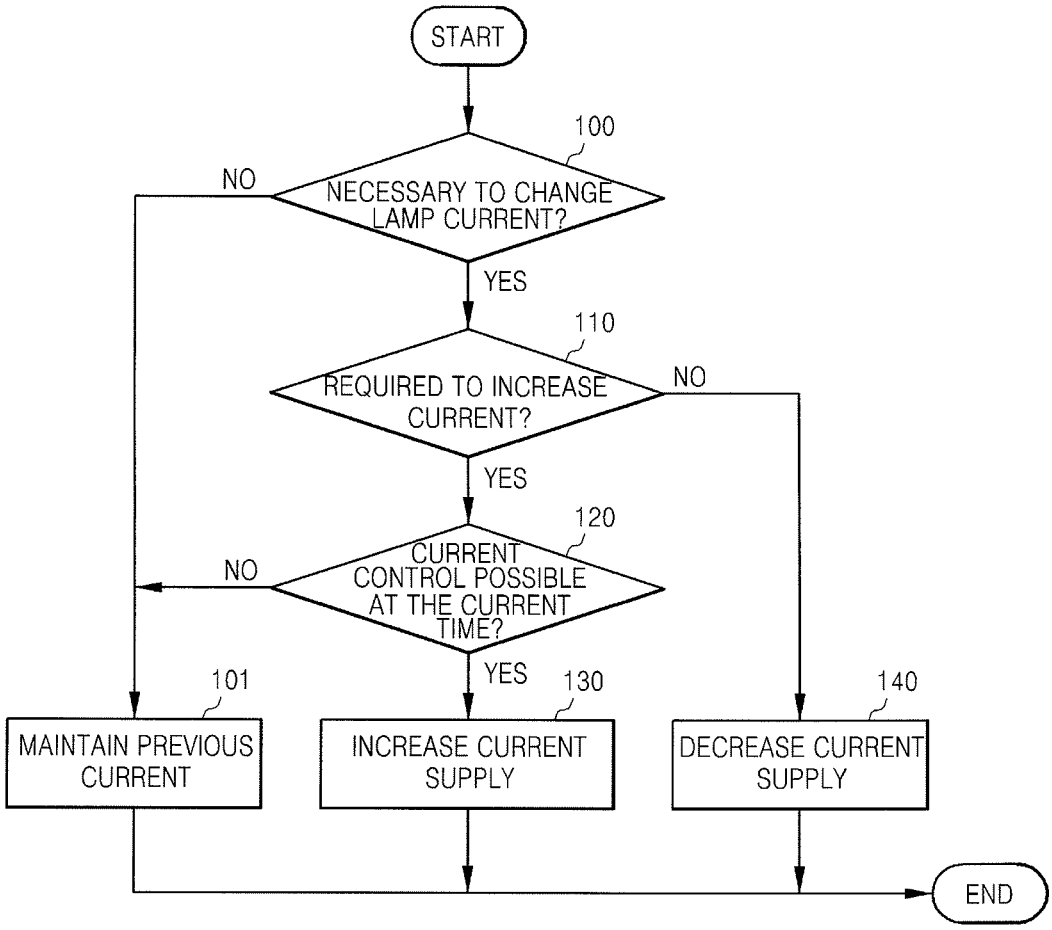
FIG. 13 is a detailed flow chart illustrating a lamp current control routine of FIG. 12.

The operations 70 and 80 to change the amount of supplied current in a stepwise manner are performed commonly according to a flow chart of FIG. 13.

Referring to FIGS. 6 and 12, the controller 40 detects zero crossing of AC power according to a detection signal from the zero crossing detector 42 and determines whether there is a need to change a current supplied to each lamp (operation 100). If there is no need to change the current, the controller 40 maintains the previous current supplied to each lamp (operation 101) and terminates the procedure.

If the controller 40 determines in operation 100 that there is a need to change the current, the controller 40 determines whether increasing the current supplied to each lamp is required (operation 110). If increasing the current is required, the controller 40 determines whether the current time is a preset current-controllable time and thus possible to control the current on an AC power half-cycle basis at the current time (operation 120). If the current time is not a preset current-controllable time, the controller 40 proceeds to operation 101. If the current time is a preset current-controllable time, the controller 40 controls the first and second switches 51 and 52 to increase currents supplied to the plurality of lamps LP1 and LP2 at different times (operation 130).

If the controller 40 determines in operation 110 that increasing the current is not required, the controller 40 controls the first and second switches 51 and 52 to decrease the currents supplied to the lamps LP1 and LP2 regardless of the current-controllable time (operation 140).

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As is apparent from the above description, various embodiments of the present general inventive concept controls currents supplied to a plurality of heat sources of a fuser to suppress flickering caused by an inrush current and also to prevent images from being unevenly fused to paper during printing.

Although various embodiments of the present general inventive concept have been illustrated and described, it would be appreciated by those skilled in the art that changes may be made in these embodiments without departing from the principles and spirit of the general inventive concept, the scope of which is defined in the appended claims and their equivalents.

What is claimed is:

1. A fuser, comprising:

a heating member having a plurality of heat sources; and a controller to control power supplied to each of the plurality of heat sources such that an amount of a current supplied to each of the plurality of heat sources is increased gradually and is changed in a stepwise manner, wherein the controller changes a chopping rate of the power to change the amount of the current, wherein the power supply unit includes a switch connected to a power source to supply the power, and wherein the controller controls the switch according to the chopping rate on a basis of a half cycle of the power.

2. The fuser according to claim 1, wherein the controller changes a chopping rate of power to change the amount of the current.

3. The fuser according to claim 2, wherein the chopping rate includes a plurality of chopping rates and the controller uses the plurality of chopping rates when changing the amount of the current alternately supplied to the plurality of heat sources in the stepwise manner.

4. An image forming apparatus, comprising:

a fuser including a plurality of heat sources;

a power supply unit to supply power to the plurality of heat sources; and a controller to control the power supply unit such that an amount of a current supplied to each of the plurality of heat sources is increased gradually and is changed in a stepwise manner from a change start time to a change end time, wherein the controller changes a chopping rate of the power to change the amount of the current, wherein the power supply unit includes a switch connected to a power source to supply the power, and wherein the controller controls the switch according to the chopping rate on a basis of a half cycle of the power.

5. The apparatus according to claim 4, wherein the controller alternately increases the chopping rate for the plurality of heat sources.

6. The apparatus according to claim 4, further comprising:

a storage unit to store a plurality of chopping rates for each of the plurality of heat sources, wherein the controller changes the chopping rate of the power to a desired one of the plurality of chopping rates.

7. The apparatus according to claim 4, wherein the power supply unit comprises:

a zero crossing detector to detect zero crossing of the power.

8. A method to control an image forming apparatus, the method comprising:

determining whether there is a need to change an amount of a current supplied to each of a plurality of heat sources provided in a fuser; and gradually increasing and changing, in a stepwise manner, the amount of the current supplied to each of the plurality of heat sources if there is a need to change the amount of the current, wherein changing the amount of the current comprises:

detecting a zero crossing of the power; and changing a chopping rate of power based on a half cycle of the power according to the detected zero crossing.

9. The method according to claim 8, wherein changing the amount of the current further comprises:

alternately increasing the chopping rate for the plurality of heat sources.

10. A fuser unit usable with an image forming apparatus, the fuser unit comprising:

a first and second heating source to fuse an image on a printing medium; and a controlling unit to apply current to the first heat source to reach a first predetermined level, and to apply current to the second heat source to reach a second predetermined level prior to the first heat source reaching the first predetermined level.

11. The fuser unit of claim 10, wherein an amount of the current applied to the first and second heat sources, respectively, is based on predetermined chopping rates, a number of heating sources to be activated, and a size of the printing medium.

12. A fuser unit usable with an image forming apparatus, the fuser unit comprising:

a first and second heating source to fuse an image on a printing medium; and a controlling unit to increase predetermined chopping rates of a first and second heat source at substantially different times during a same interval.

13. The fuser unit of claim 12, further comprising:

a power unit to receive AC power and to supply power to the first and second heating sources.

14. The fuser unit of claim 13, wherein the same interval corresponds to one half cycle of the AC power.

15. A fusing method of a fusing unit, the method comprising:

fusing an image on a printing medium by a first and second heating source;

applying current to the first heat source to reach a first predetermined level; and applying current to the second heat source to reach a second predetermined level prior to the first heat source reaching the first predetermined level.

16. A computer-readable recording medium having embodied thereon a computer program to execute a method, wherein the method comprises:

fusing an image on a printing medium by a first and second heating source;

applying current to the first heat source to reach a first predetermined level; and applying current to the second heat source to reach a second predetermined level prior to the first heat source reaching the first predetermined level.

17. A fuser including a heating member having first and second heat sources, comprising:

a controller to control power supplied to the first and second heat sources such that a first current is supplied to the first heat source at a first time and is increased gradually in a stepwise manner and a second current different than the first current is supplied to the second heat source at a second time different from the first time, wherein the controller increases the first current supplied to the first heat source to a predetermined current level in response to the first heat source requiring increased current and increases the second current supplied to the second heat source before the first current reaches the predetermined current level.

18. The fuser of claim 17, wherein the second current is increased gradually and is changed in a stepwise manner.

19. The fuser of claim 17, wherein the controller supplies the second current to the second heat source before the first current supplied to the first heat source reaches a steady-state.

* * * * *